US007141192B2

(12) United States Patent
Osaki

(10) Patent No.: US 7,141,192 B2
(45) Date of Patent: Nov. 28, 2006

(54) METHOD OF MAKING MOLDINGS

(75) Inventor: Masayuki Osaki, Tochigi (JP)

(73) Assignee: Kao Corporation, Tokyo (JP)

( * ) Notice: Subject to any disclaimer, the term of this patent is extended or adjusted under 35 U.S.C. 154(b) by 157 days.

(21) Appl. No.: 10/451,364

(22) PCT Filed: Sep. 12, 2002

(86) PCT No.: PCT/JP02/09366

§ 371 (c)(1),
(2), (4) Date: Jun. 30, 2003

(87) PCT Pub. No.: WO03/027392

PCT Pub. Date: Apr. 3, 2003

(65) Prior Publication Data

US 2004/0065980 A1 Apr. 8, 2004

(30) Foreign Application Priority Data

Sep. 21, 2001 (JP) ..... 2001-288298

(51) Int. Cl.
*B29C 49/00* (2006.01)
*B29C 49/28* (2006.01)
*B29C 49/78* (2006.01)

(52) U.S. Cl. ..... 264/40.1; 264/314; 264/523; 425/390; 425/395

(58) Field of Classification Search ..... 264/314; 425/390
See application file for complete search history.

(56) References Cited

U.S. PATENT DOCUMENTS 2,961,043 A 11/1960 Hicks
3,177,105 A * 4/1965 Wiltshire ..... 156/218
3,816,046 A * 6/1974 Farrell ..... 425/523
3,868,206 A * 2/1975 Erlandson et al. ..... 425/526
3,937,781 A * 2/1976 Allen ..... 264/314
3,955,908 A * 5/1976 Farrell ..... 425/390
3,972,976 A * 8/1976 Farrell ..... 264/314
3,975,493 A * 8/1976 Tigner et al. ..... 264/292
3,998,923 A * 12/1976 Merkle ..... 264/314
4,187,271 A * 2/1980 Rolston et al. ..... 264/258
4,473,515 A * 9/1984 Ryder ..... 264/28
4,927,642 A * 5/1990 Kunz ..... 425/508

FOREIGN PATENT DOCUMENTS

EP 1029978 * 8/2000
JP 35-9669 7/1960
JP 62013327 A * 1/1987
JP 11-314267 11/1999

* cited by examiner

*Primary Examiner*—Edmund H. Lee
(74) *Attorney, Agent, or Firm*—Oblon, Spivak, McClelland, Maier & Neustadt, P.C.

(57) ABSTRACT

A method of producing a molded article including the step of inserting an expandable and contractible hollow elastic pressing member (2) inside a hollow molded article placed in a drying mold (8) and feeding a fluid in the elastic pressing member (2) to expand the pressing member (2) thereby to press the molded article toward the inner surface of the drying mold (8), wherein the molded article is pressed onto the inner surface of the drying mold (8) by the elastic member (2) in the expanded state while exchanging the fluid in the elastic pressing member (2).

18 Claims, 2 Drawing Sheets

METHOD OF MAKING MOLDINGS

TECHNICAL FIELD

The present invention relates to a method and an apparatus for producing a molded article. It relates to a method of producing a molded article involving a step of pressing a hollow molded article of fiber with a pressing member and a molding apparatus therefor.

BACKGROUND ART

In the production of hollow, pulp-molded articles, a molded article prepared by papermaking is dried by placing the molded article in a drying mold, inserting a baglike expandable and contractible elastic pressing member inside the molded article, and feeding a fluid in the elastic pressing member to expand the pressing member within the molded article thereby pressing the molded article toward the inner surface of the drying mold.

According to this method of producing molded articles, because the elastic pressing member expands and contracts repeatedly in a drying mold of high temperature, it deteriorates significantly and needs to be replaced frequently. It has therefore been demanded to develop a method and an apparatus of producing a molded article with which molded articles can be produced in a stable manner over an extended period of time without involving frequent replacement of the pressing member.

Accordingly, an object of the present invention is to provide a method and an apparatus for producing a molded article which enable stable production of a molded article over a long period of time.

DISCLOSURE OF THE INVENTION

The present invention has achieved the above object by providing a method of producing a molded article including the step of inserting an expandable and contractible elastic pressing member inside a hollow molded article placed in a drying mold and feeding a fluid in the elastic pressing member to expand the pressing member thereby to press the molded article toward the inner surface of the drying mold, which is characterized in that the molded article is pressed onto the inner surface of the drying mold by the elastic member in its expanded state while exchanging the fluid in the elastic pressing member.

The present invention has also accomplished the above object by providing a molding apparatus for producing a molded article which comprises a hollow expandable and contractible elastic pressing member, a feed passage for feeding a fluid into the elastic pressing member, and a withdrawal passage for withdrawing the fluid from the elastic pressing member, the withdrawal passage being independent of the feed passage, wherein the withdrawal passage is equipped with a pressure control unit which controls the pressure in the elastic member in accordance with the pressure of the fluid being fed into the elastic pressing member.

BEST MODE FOR CARRYING OUT THE INVENTION

The molding apparatus according to the present invention will be described based on its preferred embodiment with reference to the drawings.

Figure 1:
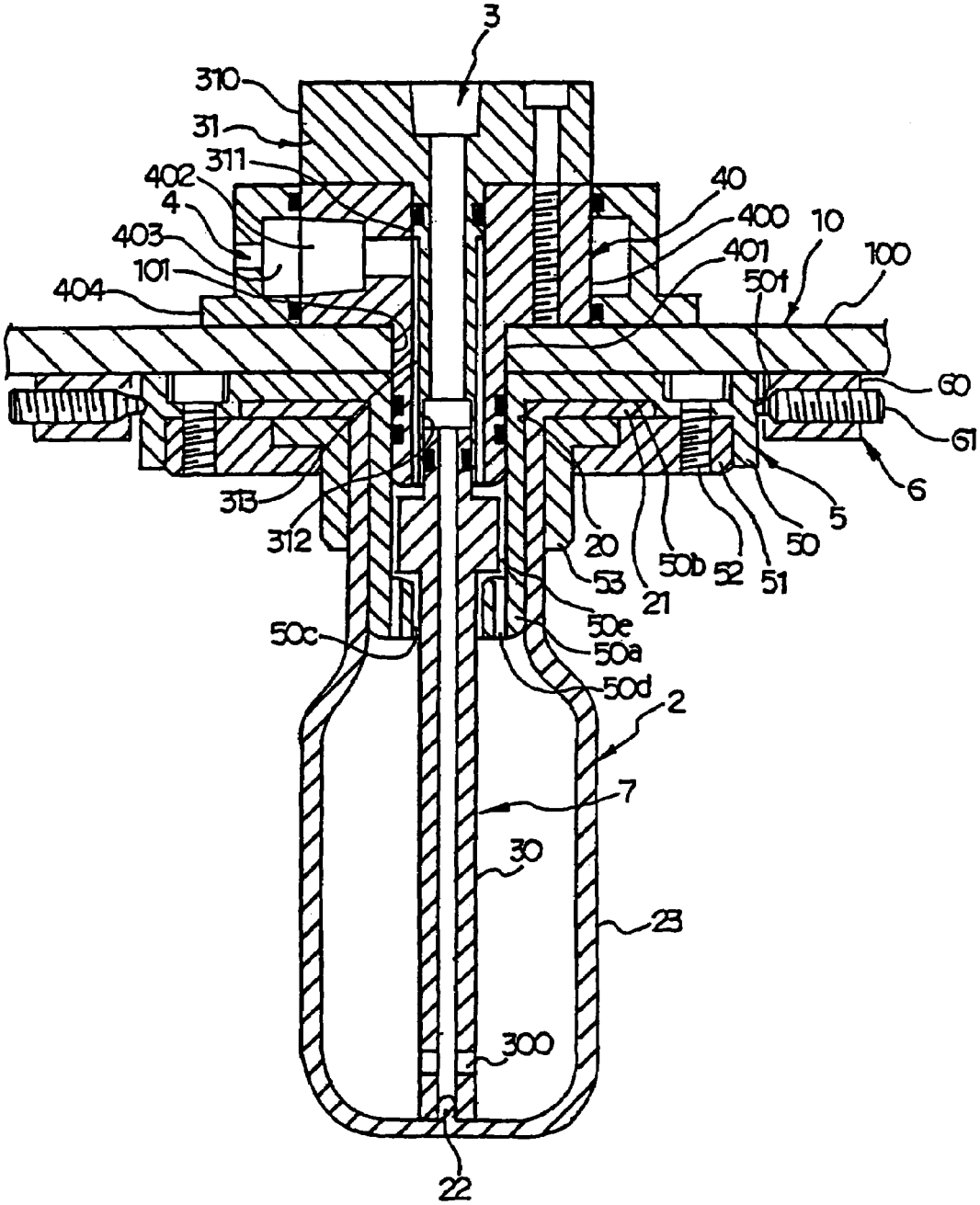
FIG. 1 is a schematic cross-section which schematically shows the essential part of an embodiment of the molding apparatus according to the present invention.
Figure 2:
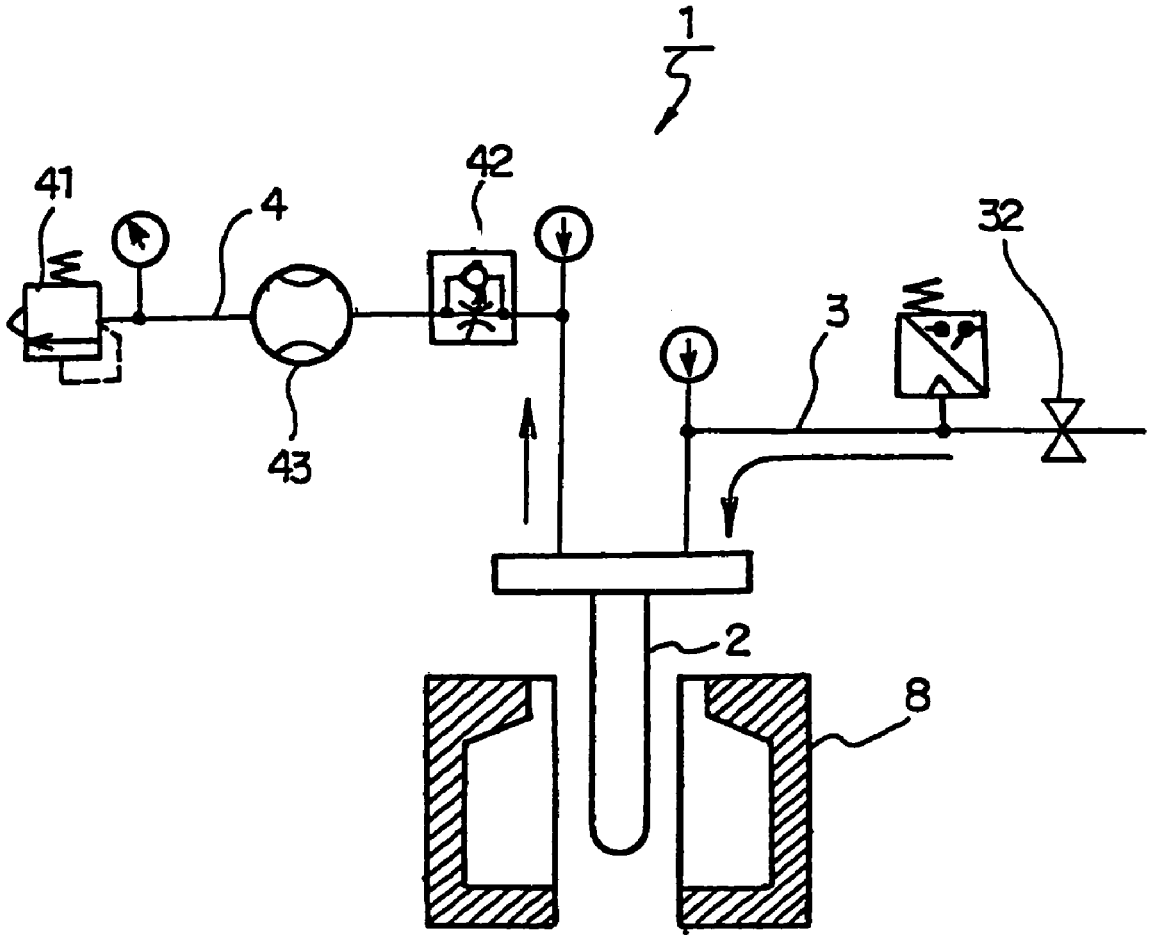
FIG. 2 is a fluid flow scheme in the essential part of the molding apparatus according to the embodiment.

FIGS. 1 and 2 show an embodiment in which the molding apparatus of the present invention is applied to a molding apparatus for producing a pulp molded article (hereinafter simply referred to as a molding apparatus). In the figures, numeral 1 indicates the molding apparatus.

As shown in FIGS. 1 and 2, the molding apparatus 1 comprises a hollow, expandable and contractible elastic pressing member 2, a feed passage 3 for feeding a fluid into the elastic pressing member 2, and a withdrawal passage 4 for withdrawing the fluid from the elastic pressing member 2. The feed passage 3 and the withdrawal passage 4 are provided independently.

The molding apparatus 1 has a driving means (not shown) for moving the frame 100 of the main body 10 of the apparatus, a compressor (not shown) for feeding a fluid through the feed passage 3, and a suction pump (not shown) for forcibly sucking up the fluid from the elastic pressing member 2. The frame 100 has an insert hole 101 through which a rotary shaft 40 (described later) is inserted via a bearing (not shown).

The elastic pressing member 2 has a flange 21 around its opening portion 20. A projection 22 whose horizontal section is an almost square is provided on the inner side of the bottom of the elastic pressing member 2. The contour of the expandable portion 23 of the elastic pressing member 2 is determined appropriately in conformity with the inner shape of a molded article to be pressed. It is preferred for the expandable portion 23 to have substantially the same shape as the inner shape of a drying mold in its state not deformed by outer force. With such a shape, the required expansion ratio of the elastic pressing member 2 can be reduced, leading to improved durability of the elastic pressing member 2.

The elastic pressing member 2 is attached to the frame 100 by means of a clamp 5 described infra.

The elastic pressing member 2 is made of an elastic material, for example, urethane, fluororubber, silicone rubber or an elastomer which are excellent in tensile strength, impact resilience, and stretchability. The elastic pressing member 2 may be formed by extensible cloth, etc. coated with these elastic materials.

As shown in FIG. 1, the feed passage 3 is formed by a core pipe 30 and a hollow driving shaft 31. Part of the core pipe 30 is disposed inside the elastic pressing member 2. The driving shaft 31, being connected to the core pipe 30 via a gasket provided on the upper end of the core pipe 30, rotates the core pipe 30.

The core pipe 30 is fitted into the driving shaft 31, and the projection 22 of the elastic pressing member 2 is fitted into the lower end of the core pipe 30. The part of the core pipe 30 which is in contact with the driving shaft 31 partly has a cross-section of almost square shape. The rotating force of the driving shaft 31 is thus transmitted to the elastic pressing member 2. Fluid ejection ports 300 are made in the lower part of the core pipe 30, through which a fluid is supplied into the elastic pressing member 2.

The driving shaft 31 is a hollow member composed of a flange 310 and a shaft 311. The shaft 311 has a recess 312 in the lower end portion thereof. The recess 312 has a cross-section of almost square shape in agreement with the upper end portion of the core pipe 30. The peripheral surface of the shaft 311 has a channel 313 which forms a part of the fluid withdrawal passage 4.

As shown in FIG. 2, the feed passage 3 is equipped with a pressure valve 32 which is controlled by sequence control, and the like, by which feeding and stopping of a fluid into the elastic pressing member 2 and the feed time are controlled.

The withdrawal passage 4 is formed by a rotary shaft 40 and the channel 313. Part of the rotary shaft 40 rotates together with the driving shaft 31. The rotary shaft 40 is a hollow member composed of a flange 400 and a shaft 401. The flange 400 is fixed to the flange 310 of the driving shaft 31 with a bolt. A gasket is provided around the shaft 401. The gasket is in contact with the inner side of a projection 50*a* hereinafter described to prevent fluid leaks. The rotary shaft 40 is inserted through the insert hole 101 of the flame 100 via a bearing (not shown). The flange 400 has an opening 402 which opens on the peripheral side thereof. The rotary shaft 40 is supported by a bearing member 404. The bearing member 404 has a discharge port 403 leading to the opening 402. A fluid is to be discharged out of the elastic pressing member 2 through the discharge port 403.

As shown in FIG. 2, the withdrawal passage 4 is equipped with a pressure control valve (means for pressure control) 41, a flow control valve (means for flow control) 42, and a flow meter 43. The pressure control valve 41 controls pressure of the fluid supplied into the elastic pressing member 2. The flow meter 43 monitors the flow rate of the fluid being withdrawn through the withdrawal passage 4 and sends the data to the flow control valve 42. The fluid withdrawn from the discharge port 403 is discharged outside through the flow control valve 42, the flow meter 43, and the pressure control valve 41.

The pressure control valve 41 is a so-called relief valve. When a fluid is fed into the elastic pressing member 2 under a pressure exceeding a predetermined level, the pressure control valve 41 operates to discharge the fluid from the discharge port so as to lower the pressure to or below the predetermined level thereby making it possible to exchange the fluid in the elastic pressing member 2. The flow control valve 42 is a throttle valve. It controls the flow rate of the fluid in the withdrawal passage 4 based on the output of the flow meter 43. In this way, the flow control valve 42 provided in the withdrawal passage 4 enables flow control of the fluid which is fed through the feed passage 3 and flows in the elastic pressing member 2 until it is discharged through the withdrawal passage 4.

As shown in FIG. 1, the clamp 5 is composed mainly of two annular clamping parts 50 and 51. These clamping parts are fixed by a volt 52 with the flange 21 of the elastic pressing member held therebetween.

The clamping member 50 has a projection 50*a* and a depression 50*b*. The projection 50*a* is inserted in the opening 20 of the elastic pressing member 2, and the depression 50*b* comes into contact with the flange 21 of the elastic pressing member 2.

The projection 50*a* has a hole 50*c* in the center of the lower end surface thereof. Around the hole 50*c* are made flow holes 50*d* which constitute the withdrawal passage 4. The projection 50*a* has therein a space in which the joint between the core pipe 30 and the driving shaft 31 is fitted.

The fluid ejected from the ejection ports 300 of the core pipe 30 circulates in the elastic pressing member 2, passes through the flow holes 50*d*, the clearance 50*e*, and the channel 313, and is discharged out of the elastic pressing member 2.

The clamping part 50 has, on its outer peripheral side, grooves or holes 50*f* having a V-shaped cross-section in which a ball of a ball plunger 61 (described later) snaps.

The clamping part 51 clamps the flange 21 of the elastic pressing member 2. A collared cylinder 53 for buffering is disposed between the clamping part 51 and the elastic pressing member 2. The collared cylinder 53 protects the clamping part 51 and the expandable portion 23 of the elastic pressing member 2 from damage when the corner part of the clamping part 51 repeatedly comes into contact with the expandable portion 23.

The main body 10 has a positioning mechanism 6 for positioning the clamp 5 on the frame 100 to which the clamp 5 is attached.

The positioning member 6 is composed of a positioning ring 60 fixed to the side where the clamp 5 is attached and a plurality of ball plungers 61 screwed in the positioning ring 60.

The positioning ring 60 has a plurality of evenly spaced threaded holes radially piercing from the outer periphery to the inner periphery. The ball plungers 61 are screwed in the threaded holes.

Each ball plunger 61 is composed of a closed-end cylinder, a coil spring (not shown) contained in the closed-end cylinder, and a ball fixed at the tip of the coil spring. The closed-end cylinder has a male thread on its outer peripheral surface and a spanner hole on its base. The ball is brought into contact with the clamping part 50, and the closed-end cylinder is screwed in, whereby the ball is pressed to the clamping part 50 by the elastic force of the coil spring.

The ball plunger 61 is turned by a spanner fitted into the spanner hole to move the clamping part 50 in the horizontal direction in the figure. Thus, the clamp 5 can be positioned precisely with respect to the main body 10.

The molding apparatus 1 has a twisting mechanism 7 for twisting the elastic pressing member 2. The twisting mechanism 7 comprises a hollow core pipe 30 inserted into the elastic pressing member 2, the driving shaft 31, and a driving unit (not shown) which transmits a driving force to the driving shaft 31.

When a driving force is transmitted to the driving shaft 31 by the driving unit, the driving shaft 31 and the core pipe 30 rotate together. With this rotation the expandable portion 23 of the elastic pressing member 2 also rotates. Because the elastic pressing member 2 is fixed at its flange 21 by the clamping parts 50 and 51, the elastic pressing member 2 begins to be twisted around the core pipe 30 after the core pipe 30 reaches a certain angle of rotation. As the expandable portion 23 of the elastic pressing member 2 is twisted around the core pipe 30, the elastic pressing member 2 reduces its horizontal cross-sectional size. As a result, the elastic pressing member 2 can be put in and out of a molded article at a high speed without touching the inner surface of the molded article even when the article has a bottle shape with a narrow neck.

As previously described, the core pipe 30 has ejection ports 300 in its lower part, through which a fluid is fed into the elastic pressing member 2. A plurality of ejection ports 300 may be made along the vertical direction of the core pipe 30. In this case, if one port is obstructed, fluid continues being ejected through the other ones so that the expandable portion 23 can be twisted more largely and smoothly.

In the molding apparatus 1, when the elastic pressing member 2 is fitted to the main body 10, the clamping part 50 is placed on a horizontal table with its projection 50*a* up, and the opening portion 20 of the elastic pressing member 2 is fitted over the projection 50*a*. The buffering member and the clamping part 51 are attached. These members are clamped by screws to hold the flange 21 of the elastic pressing member 2 between the clamping parts 50 and 51. The core pipe 30 is inserted in the hole of the projection 50*a* of the clamping part 50. The clamping part 50 is fitted in the positioning ring 60. It is advisable that the tip of the balls of the ball plungers 61 be previously stuck out slightly over the inner periphery of the positioning ring 60.

In the beginning of fitting the clamping part 50 in, the ball of each ball plungers 61 contacts with the outer periphery of the clamping part 50 and, when it meets the groove or hole, it snaps into the groove or hole by the spring elastic force and the clamping part 50 is temporarily fixed to the frame 100 of the main body 10. By this temporary fixing, it is easy to attach the elastic pressing member 2 to the main body 10. After the temporary attachment, the ball plungers 61 are screwed in to move the clamping part 50 until the clamp 5 is precisely positioned with respect to the main body 10. The clamp 5 is then fixed to the main body 10. In detaching the elastic pressig member 2 from the main body 10, the snap fit of the balls of the ball plungers 61 in the grooves or holes is relieved to bring the balls just in contact with the outer periphery of the clamping part 50, and the clamping part 50 is removed from the main body 10. The elastic pressing member 2 is then detached from the clamp 5.

As shown in FIG. 2, the molding apparatus 1 has a drying mold 8 of the type that a pair of splits are joined to form a cavity. The drying mold 8 is configured to be opened and closed by a clamping mechanism (not shown) with a predetermined timing which is controlled by a certain sequence. A drying mold ordinarily employed for the production of pulp molded articles can be used as the drying mold 8.

A preferred embodiment of the present invention will then be described with reference to production of a pulp molded article using the molding apparatus 1.

A hollow pulp-molded article (not shown) is placed in the drying mold 8. The method of making the pulp molded article is not particularly limited. It is preferred to use a pulp molded article prepared by a papermaking technique in which a solid content of a pulp slurry is deposited on the papermaking screen of a papermaking mold.

The pulp molded article put into the drying mold 8 preferably has a water content of 10 to 40% by weight, particularly 20 to 30% by weight. The temperature of the drying mold 8 is preferably 100 to 250° C., more preferably 160 to 210° C.

The elastic pressing member 2 is inserted in the molded article. It is preferred that the elastic pressing member 2 to be inserted be previously twisted by the twisting mechanism 7. After insertion, the driving shaft 31 operates to rotate the core pipe 30 to untwist the elastic pressing member 2.

A fluid is fed into the elastic pressing member 2 through the feed passage 3 from the compressor to expand the expandable portion 23 of the elastic pressing member 2. The fluid used for expansion includes compressed air (heated air), inert gases, e.g., nitrogen gas, oil (heated oil), and other various liquids. The feed pressure of the fluid is preferably 0.01 to 5 MPa, more preferably 0.1 to 3 MPa.

With the elastic pressing member 2 kept in its expanded state, the molded article is pressed toward the inner wall of the drying mold 8 by the expandable portion 23 while exchanging the fluid in the elastic pressing member 2. The fluid exchange is performed by setting the relief pressure of the pressure control valve 41. The relief pressure is preferably 0.3 to 2.0 MPa, more preferably 0.6 to 1.0 MPa, for reducing the molded article drying time and for obtaining a molded article with satisfactory surface conditions.

A higher circulating flow rate of the fluid in the elastic pressing member 2 is preferred for cooling the elastic pressing member 2. Taking the production efficiency and economy into consideration as well, a preferred circulating flow rate is 1 to 200 normal L/min, particularly 5 to 100 normal L/min. The circulating flow rate (normal L/min) of the fluid in the elastic pressing member 2 is the value measured with the flow meter 43 shown in FIG. 2.

After completion of pressing by the elastic pressing member 2, the fluid feed into the elastic pressing member 2 is stopped, and the fluid is forcibly withdrawn from the elastic pressing member 2 by suction with the suction pump. Meantime, the elastic pressing member 2 is twisted by the twisting mechanism 7, and the elastic pressing member 2 is taken out of the molded article. The drying mold 8 is opened to remove the molded article, which is, if necessary, subjected to treatment such as trimming, coating, printing or the like.

As described above, according to the method of producing a molded article by use of the molding apparatus 1 of the present embodiment, a fluid is fed to the elastic pressing member in the high-temperature drying mold 8 through the feed passage 3 and simultaneously, the fluid is withdrawn through the withdrawal passage 4 which is independent of the feed passage 3. In this way, the fluid is exchanged within the elastic pressing member 2 while cooling the elastic pressing member 2. As a result, the durability of the pressing member is greatly improved, making it possible to produce molded articles in a stable manner for an extended period of time.

In using the molding apparatus 1, where the opening portion 20 of the elastic pressing member 2 has previously been fixed by the clamp 5, it is easy to attach or detach the elastic pressing member 2 to or from the main body 10.

Since the molding apparatus 1 has a positioning mechanism 6, the elastic pressing member 2, as attached to the main body 10 via the clamp 5, can be positioned precisely by the positioning mechanism 6.

Once the elastic pressing member 2 is positioned precisely, when another elastic pressing member is fitted to the main body 10, the accurate fitting position can easily be reproduced. A plurality of elastic pressing members previously attached to as many clamps may be prepared, which will make it smoother to attach and detach the elastic pressing member 2 to and from the main body 10.

The present invention is not limited to the above-described embodiments, and changes and modifications can be made therein without departing from the spirit and scope thereof.

For example, while the feed passage and the withdrawal passage are preferably configured as described in the foregoing embodiments, they may be designed otherwise.

The molding apparatus of the present invention is preferably configured such that the elastic pressing member 2 may be twisted around the core pipe 30 by holding the opening portion 20 of the elastic pressing member 2 with the clamp 5 and fixing the core pipe 30 at the projection 22 of the elastic pressing member 2 as in the molding apparatus 1 according to the embodiment described above. However, where, for example, the inside of the elastic pressing member 2 is evacuated by suction, the elastic pressing member 2 may be twisted around the core pipe 30 with the bottom of the elastic pressing member 2 fixed to the lower end of the core pipe 30 by the suction force.

The molding apparatus of the present invention is especially effective in production of bottle-shaped molded articles having a neck as described. It is also applicable to production of molded articles of other forms, such as cartons with a wide opening, ornaments, and the like.

In Examples and Comparative Examples hereinafter given elastic pressing members were repeatedly expanded and contracted in a heat drying mold to examine the durability of the elastic pressing members.

EXAMPLE 1

An elastic pressing member was repeatedly expanded and contracted in a heat drying mold while exchanging air in the elastic pressing member under the drying conditions described below. The time of repetition up to breakage of the elastic pressing member was recorded.

Air was fed into the elastic pressing member under the following conditions 1 to 3 repeated in cycle.

1. Air pressure (low): 0.2 Mpa, 2 seconds
2. Air pressure (high): 0.6 Mpa, 13 seconds
3. Vented to the atmosphere: 15 seconds (relief pressure of pressure control valve 41: 0.5 MPa; feed pressure: 0 Pa)

Drying Conditions:

Elastic pressing member: made of silicone rubber

Heat drying mold: made of aluminum

Mold temperature: 200° C.

Circulating air flow rate in elastic pressing member 2: 80 normal L/min

EXAMPLE 2

The elastic pressing member was repeatedly expanded and contracted in the heat drying mold in the same manner as in Example 1, except for changing the circulating air flow rate to 60 normal L/min.

COMPARATIVE EXAMPLE

The same procedure as in Example 1 was repeated except for air was not circulated.

As a result, the time of repetition of expansion and contraction of the elastic pressing member up to breakage of the elastic pressing member in Examples 1 and 2 was about 7 times (7183) and about 2.5 times (2480), respectively, that in Comparative Example (991), proving that the durability of the elastic pressing member is markedly improved in Examples.

INDUSTRIAL APPLICABILITY

The present invention makes it possible to produce molded articles in a stable manner for an extended period of time.

The invention claimed is:

1. A method of producing a hollow molded article comprising:

inserting an expandable and contractible hollow elastic pressing member inside a hollow molded article placed in a drying mold;

removing liquid from said hollow molded article by feeding a fluid in said elastic pressing member to expand said pressing member thereby to press said hollow molded article toward an inner surface of said drying mold;

pressing said molded article against the inner surface of said drying mold with the elastic member in the expanded state while feeding fluid into said elastic pressing member through a feed passage and withdrawing fluid from said elastic pressing member through an independent withdrawal passage;

measuring a flow rate of fluid withdrawn through the withdrawal passage with a flow meter; and controlling the flow rate through the withdrawal passage with a flow control unit based on the flow rate measured by the flow meter.

2. The method of producing a hollow molded article according to claim 1, wherein said hollow molded article is a fiber molded article prepared by wet papermaking.

3. A molding apparatus for producing a molded article comprising:

an expandable and contractible hollow elastic pressing member, said pressing member configured to remove liquid from a hollow molded article by pressing said hollow molded article onto an inner surface of a drying mold;

a feed passage for feeding a fluid into said elastic pressing member;

a withdrawal passage for withdrawing said fluid from said elastic pressing member, said withdrawal passage being independent of said feed passage;

a flow meter for measuring a flow rate of fluid withdrawn through the withdrawal passage; and a flow control unit for controlling the flow rate of said fluid being withdrawn through said withdrawal passage based on the flow rate measured by the flow meter, wherein said withdrawal passage is equipped with a pressure control unit which controls the pressure in said elastic member in accordance with the pressure of said fluid being fed into said elastic pressing member.

4. The method of producing a hollow molded article according to claim 1, further comprising heating the drying mold.

5. The method of producing a hollow molded article according to claim 4, wherein said heating includes heating said drying mold to between approximately 100° C. and approximately 250° C.

6. The method of producing a hollow molded article according to claim 5, wherein said heating includes heating said drying mold to between approximately 160° C. and approximately 210° C.

7. The method of producing a hollow molded article according to claim 1, further comprising rotating a driving shaft while supplying the fluid to the elastic pressing member.

8. The method of producing a hollow molded article according to claim 7, further comprising rotating a rotary shaft while withdrawing the fluid from the elastic pressing member.

9. The method of producing a hollow molded article according to claim 1, further comprising rotating a rotary shaft while withdrawing the fluid from the elastic pressing member.

10. The molding apparatus according to claim 3, further comprising a heating element configured to heat the drying mold.

11. The molding apparatus according to claim 10, wherein said heating element is configured to heat said drying mold to between approximately 100° C. and approximately 250° C.

12. The molding apparatus according to claim 11, wherein said heating element is configured to heat said drying mold to between approximately 160° C. and approximately 210° C.

13. The molding apparatus according to claim 3, further comprising a rotary shaft configured to rotate while the fluid is withdrawn from the elastic pressing member.

14. A molding apparatus for producing a molded article comprising:

an expandable and contractible hollow elastic pressing member, said pressing member being configured to remove liquid from a hollow molded article by pressing said hollow molded article onto an inner surface of a drying mold;

a withdrawal passage for withdrawing said fluid from said elastic pressing member;

a flow meter for measuring a flow rate of fluid withdrawn through the withdrawal passage;

a flow control unit for controlling the flow rate of said fluid being withdrawn through said withdrawal passage based on the flow rate measured by the flow meter; and means for exchanging fluid in said elastic pressing member while said elastic pressing member is pressing said hollow molded article.

15. The molding apparatus according to claim 14, further comprising a pressure valve configured to control feeding of the fluid into the elastic pressing member.

16. The molding apparatus according to claim 14, further comprising a heating element configured to heat the drying mold.

17. The molding apparatus according to claim 16, wherein said heating element is configured to heat said drying mold to between approximately 100° C. and approximately 250° C.

18. The molding apparatus according to claim 17, wherein said heating element is configured to heat said drying mold to between approximately 160° C. and approximately 210° C.

* * * * *